US008968105B2

(12) United States Patent
Adiraju et al.

(10) Patent No.: US 8,968,105 B2
(45) Date of Patent: Mar. 3, 2015

(54) REORGANIZING A WAGERING GAME MACHINE'S NVRAM

(75) Inventors: Srinivyasa M. Adiraju, Vernon Hills, IL (US); Ranjan Dasgupta, Naperville, IL (US); Steven J. Lee, Naperville, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 1496 days.

(21) Appl. No.: 12/278,875

(22) PCT Filed: Feb. 13, 2007

(86) PCT No.: PCT/US2007/004141

§ 371 (c)(1),
(2), (4) Date: Aug. 8, 2008

(87) PCT Pub. No.: WO2007/095368

PCT Pub. Date: Aug. 23, 2007

(65) Prior Publication Data

US 2009/0055611 A1 Feb. 26, 2009

Related U.S. Application Data

(60) Provisional application No. 60/743,284, filed on Feb. 14, 2006, provisional application No. 60/744,969, filed on Apr. 17, 2006.

(51) Int. Cl.
*G07F 17/32* (2006.01)

(52) U.S. Cl.
CPC ..... *G07F 17/32* (2013.01); *G07F 17/3202* (2013.01)
USPC ..... 463/43; 463/1; 463/24; 463/25; 463/29

(58) Field of Classification Search
CPC .. G07F 17/32; G07F 12/0238; G07F 12/0246
USPC ..... 340/575, 576, 573.1, 573.2, 937; 351/200; 180/271; 463/2–8, 23, 30–32, 463/34, 37, 42–45, 50; 273/108.1, 108.3, 273/108.4, 118 A, 119 A, 122 A, 123 A, 273/125 A, 126 A, 138.2, 141 A, 142 JB, 273, 273/317.1, 317.3, 317.4, 317.5, 317.6; 360/313–319, 324–327; 324/207.21, 324/235, 252; 365/8, 158, 226; 345/156–158, 167, 473–474, 557, 664, 345/679; 711/3, 123, 125–126, 129–132, 711/135, 138–140, 144
See application file for complete search history.

(56) References Cited

U.S. PATENT DOCUMENTS 5,473,569 A * 12/1995 Chwu ..... 365/218
5,579,522 A 11/1996 Christeson et al.

(Continued)

FOREIGN PATENT DOCUMENTS

WO WO-2007095368 A3 8/2007
WO WO-2009061488 A1 5/2009

OTHER PUBLICATIONS

Linux System Administrators Guide: 5.11 Disks without filesystems (retrieved from http://www.tldp.org/LDP/sag/html/disk-no-fs.html; Dec. 26, 2005 version, p. 1; webarchive link: https://web. archive. org/web/20051226010159/http://www.tldp.org/LDP/sag/html/disk-no-fs.html.*

(Continued)

*Primary Examiner* — Jasson Yoo
(74) *Attorney, Agent, or Firm* — Nixon Peabody LLP

(57) ABSTRACT

This document discusses, among other things, systems and methods for managing the contents of NVRAM in a wagering game machine. A method copies a first data of an NVRAM module to a storage device, wherein the NVRAM module is associated with a wagering game machine and then copies a second data to the NVRAM module.

32 Claims, 3 Drawing Sheets

(56) References Cited

U.S. PATENT DOCUMENTS

| | | | | |
|---|---|---|---|---|
| 5,680,570 | A | 10/1997 | Rantala et al. | |
| 6,205,548 | B1 | 3/2001 | Hasbun | |
| 6,251,014 | B1 * | 6/2001 | Stockdale et al. | 463/16 |
| 6,314,483 | B1 * | 11/2001 | Goto et al. | 710/107 |
| 6,322,450 | B1 * | 11/2001 | Nakano | 463/40 |
| 6,582,311 | B1 * | 6/2003 | Sugimura | 463/43 |
| 6,595,860 | B1 * | 7/2003 | Yamamoto et al. | 463/43 |
| 6,743,103 | B2 * | 6/2004 | Sugimura | 463/43 |
| 6,775,738 | B2 * | 8/2004 | Ash et al. | 711/113 |
| 6,804,763 | B1 * | 10/2004 | Stockdale et al. | 711/170 |
| 7,111,141 | B2 | 9/2006 | Nelson | |
| 7,384,339 | B2 * | 6/2008 | LeMay et al. | 463/30 |
| 7,441,084 | B2 * | 10/2008 | Henshaw et al. | 711/118 |
| 7,610,462 | B2 * | 10/2009 | Gagner et al. | 711/162 |
| 7,618,317 | B2 * | 11/2009 | Jackson | 463/24 |
| 7,704,147 | B2 * | 4/2010 | Quraishi et al. | 463/42 |
| 7,722,468 | B2 * | 5/2010 | Cockerille et al. | 463/43 |
| 7,736,234 | B2 * | 6/2010 | Cockerille et al. | 463/43 |
| 7,798,900 | B2 * | 9/2010 | Nguyen et al. | 463/29 |
| 7,819,750 | B2 * | 10/2010 | Lam et al. | 463/43 |
| 7,931,533 | B2 * | 4/2011 | LeMay et al. | 463/29 |
| 7,988,559 | B2 * | 8/2011 | Yoseloff et al. | 463/42 |
| 2002/0026566 | A1 | 2/2002 | Awada et al. | |
| 2002/0049909 | A1 | 4/2002 | Jackson et al. | |
| 2003/0073497 | A1 | 4/2003 | Nelson | |
| 2003/0097522 | A1 * | 5/2003 | Lay et al. | 711/103 |
| 2004/0198479 | A1 | 10/2004 | Martinek et al. | |
| 2005/0010738 | A1 | 1/2005 | Stockdale et al. | |
| 2005/0251617 | A1 | 11/2005 | Sinclair et al. | |
| 2006/0287109 | A1 * | 12/2006 | Mercado et al. | 463/43 |
| 2007/0011427 | A1 | 1/2007 | Nelson | |
| 2008/0026853 | A1 * | 1/2008 | Crowder, Jr. | 463/43 |
| 2010/0248819 | A1 | 9/2010 | Shimabukuro et al. | |

OTHER PUBLICATIONS

"International Application Serial No. PCT/US2007/004141, Search Report mailed Jun. 3, 2008", 4 Pgs.

"International Application Serial No. PCT/US2007/004141, Written Opinion mailed Jun. 3, 2008", 6 Pgs.

"U.S. Appl. No. 12/741,883 , Response filed Jul. 9, 2012 to Non Final Office Action mailed Feb. 8, 2012", 16 pgs.

"U.S. Appl. No. 12/741,883, Non Final Office Action mailed Feb. 8, 2012", 15 pgs.

"International Application Serial No. PCT/US2007/004141, International Preliminary Report on Patentability mailed May 8, 2009", 12 pgs.

"International Application Serial No. PCT/US2008/012604, International Preliminary Report on Patentability mailed Feb. 25, 2010", 11 pgs.

"International Application Serial No. PCT/US2008/012604, International Search Report mailed Jan. 16, 2009", 4 pgs.

"International Application Serial No. PCT/US2008/012604, Written Opinion mailed Jan. 16, 2009", 8 pgs.

* cited by examiner

REORGANIZING A WAGERING GAME MACHINE'S NVRAM

RELATED APPLICATIONS

This patent application is a U.S. National Stage Filing under 35 U.S.C. 371 from International Patent Application Serial No. PCT/US2007/004141, filed Feb. 13, 2007, and published on Aug. 23, 2007 as WO 2007/095368 A2, which claims the benefit of priority of U.S. Provisional Patent Application Ser. No. 60/743,284 entitled "REORGANIZING OF NVRAM USING A TEMPORARY STORAGE DEVICE," filed on Feb. 14, 2006; and of U.S. Provisional Patent Application Ser. No. 60/744,969 entitled "REORGANIZING A WAGERING GAME MACHINE'S NVRAM USING A TEMPORARY STORAGE DEVICE," filed on Apr. 17, 2006, the contents of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wagering game machines, and more particularly, to memory management within wagering game machines.

BACKGROUND

Wagering game machines, such as slot machines, video poker machines, and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are most likely attracted to the most entertaining and exciting of the machines. Consequently, shrewd operators strive to employ the most entertaining and exciting machines available because such machines attract frequent play and increase profitability for the operator. In the competitive wager gaming machine industry, there is a continuing need for manufacturers to produce new game types or to enhance entertainment and excitement associated with existing wager gaming machines.

Computerized wagering games have largely replaced traditional mechanical wagering game machines such as slot machines, and are rapidly being adopted to implement computerized versions of games that are traditionally played live such as poker and blackjack. These computerized games provide many benefits to the game owner and to the gambler, including greater reliability than can be achieved with a mechanical game or human dealer, more variety, sound, and animation in presentation of a game, and a lower overall cost of production and management.

One aspect of modern computerized wagering games is that a single console or cabinet is capable of providing several different games, similar to a personal computer. In certain wagering game machines, non-volatile random access memory (NVRAM) is used to store critical data. Such critical data may include game history data, accounting data, security data, player tracking data, or other game state data. Typically, modifying the set of games on a wagering game machine necessitates re-initializing or re-formatting the NVRAM and losing any existing critical data. Retaining critical data between game installations is advantageous to maintain a consistent playing environment. When installing or modifying games on a computerized wagering machine, it is desirable to effectively manage critical data to ensure game integrity.

DETAILED DESCRIPTION

Example Operating Environment

Figure 1:
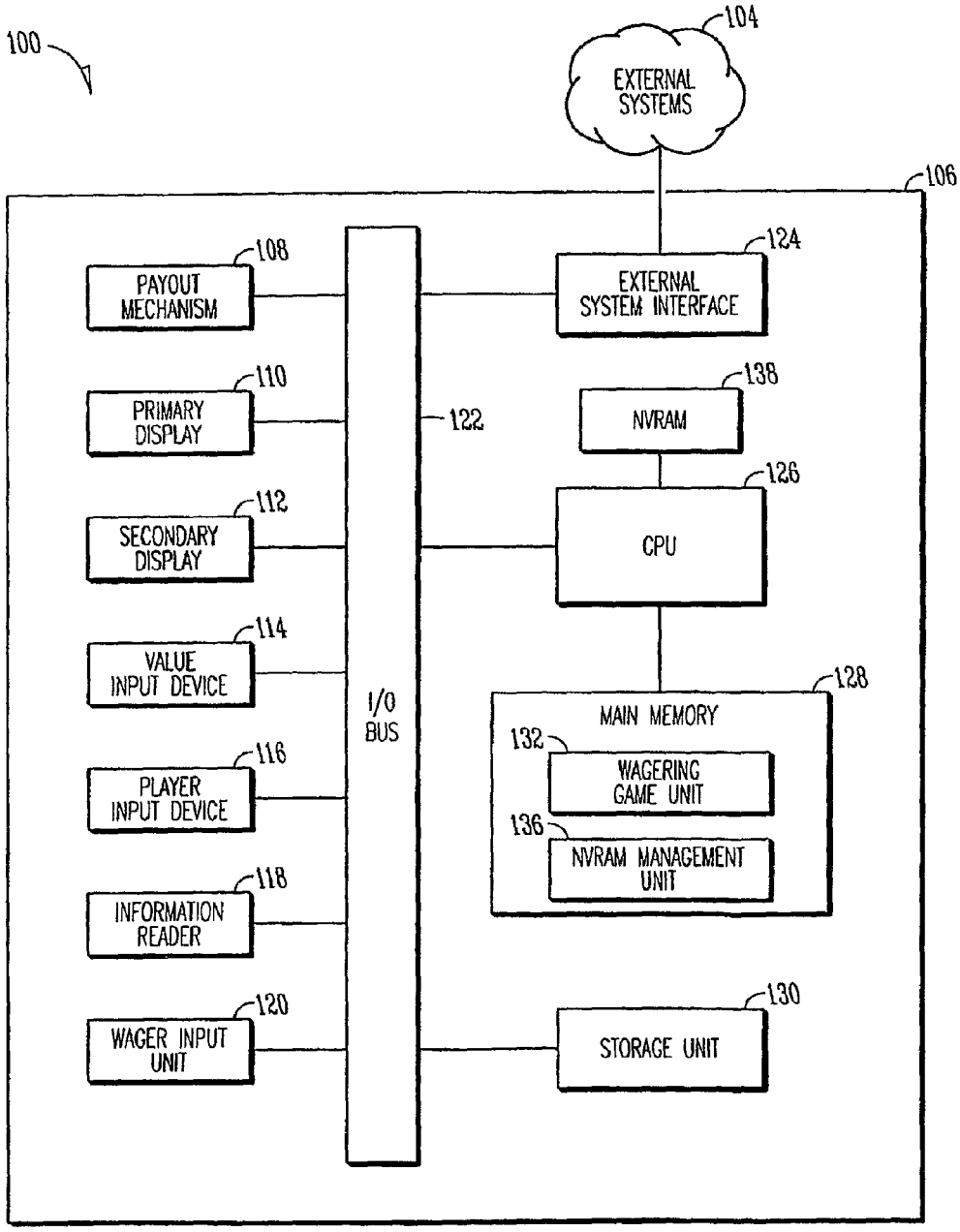
FIG. 1 is a block diagram illustrating a wagering game machine, according to example embodiments of the invention.

FIG. 1 is a block diagram illustrating a control system 106 for a wagering game machine, according to example embodiments of the invention. As shown in FIG. 1, the control system 106 includes a central processing unit (CPU) 126 connected to main memory 128, which includes a wagering game unit 132 and a non-volatile random access memory (NVRAM) management unit 136. An NVRAM module 138 is connected to the CPU 126. In some embodiments, the NVRAM module 138 is a battery-backed random access memory (RAM). In other embodiments, the NVRAM module 138 is a flash memory module, magnetic RAM, FeRAM, phase-change memory (PRAM), carbon nanotube technology, or other types of memory capable of preserving information when its power is off. In one embodiment, the wagering game unit 132 can receive wagers and conduct wagering games, such as video poker, video blackjack, video slots, video lottery, etc. In one embodiment, the NVRAM management unit 136 manages an NVRAM module 138, as described herein.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, wager input unit 120, and storage unit 130. In one embodiment, the wager input unit 120 can electronically receive wagering value (e.g., monetary value) from a player's casino account or other suitable "cashless gaming" value source. The I/O bus 122 is also connected to an external system interface 124, which is connected to external systems 104 (e.g., wagering game networks).

In one embodiment, the control system 106 can include additional peripheral devices and/or more than one of each component shown in FIG. 1. For example, in one embodiment, the control system 106 can include external system interfaces 124 and multiple CPUs 126. In one embodiment, any of the components can be integrated or subdivided. Additionally, in one embodiment, the components of the control system 106 can be interconnected according to any suitable interconnection architecture (e.g., directly connected, hypercube, etc.).

In one embodiment, any of the components of the control system 106 (e.g., the NVRAM management unit 136) can include hardware, firmware, and/or software for performing the operations described herein. Furthermore, any of the components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
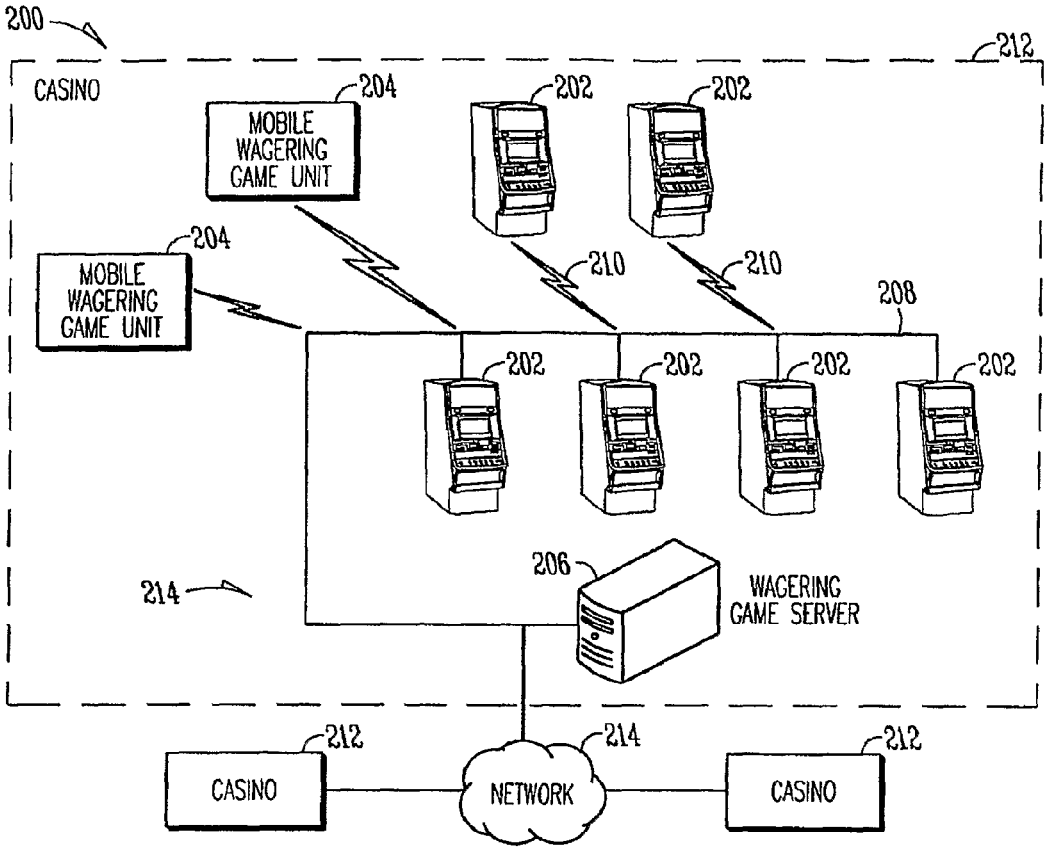
FIG. 2 is a block diagram illustrating a wagering game network, according to example embodiments of the invention.

FIG. 2 is a block diagram illustrating a wagering game network 200, according to example embodiments of the invention. The wagering game network 200 includes a plurality of casinos 212 connected to a communications network 214. Each of the plurality of casinos 212 includes a local area network 214, which includes wagering game machines 202 and mobile wagering game units 204 connected to a wagering game server 206. The wagering game machines 202, mobile wagering game unit 204, and wagering game server 206 can include hardware and machine-readable media including instructions for reorganizing an NVRAM module, as described herein. In one embodiment, the wagering game server 206 can perform NVRAM reorganization in concert with serving wagering games over the local area network.

The wagering game machines described herein can take any suitable form, such as floor standing models, handheld mobile units, bartop models, workstation-type console models, etc. In one embodiment, the wagering game network 200 can include other network devices, such as accounting servers, wide area progressive servers, and/or other devices suitable for use in connection with embodiments of the invention.

The components of each casino 212 can communicate over wired 208 and/or wireless connections 210. Furthermore, they can employ any suitable connection technology, such as Bluetooth, 802.11, Ethernet, public switched telephone networks, SONET, etc.

Example Operations

Typically, a game stores critical data in NVRAM. Critical data may include one or more of game outcome, credit balance, reel positions, game history, random number generator seeds, game configuration, machine configuration, player information, or other state information or information critical to the operation and record keeping in a gaming machine. The critical data is stored in NVRAM to maintain a player's game state in the case of a sudden power failure. In some embodiments, NVRAM is formatted with fixed partitions to optimize file system operations. In other embodiments, NVRAM is formatted with dynamic partitions.

Figure 3:
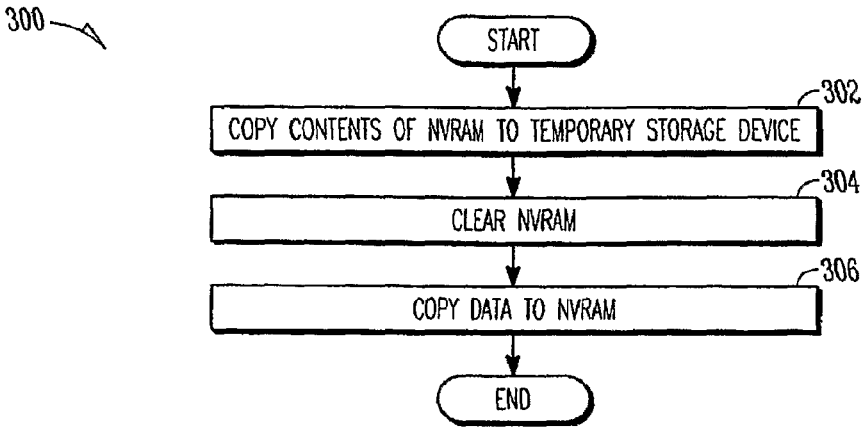
FIG. 3 is a flowchart illustrating generally a method of managing the contents of NVRAM, according to example embodiments of the invention.

FIG. 3 is a flowchart illustrating generally a method 300 of managing the contents of NVRAM. At 302, the contents of an NVRAM module 138 are copied to a temporary storage device. In an embodiment, the contents are copied using a structured copy, for example using a file system to copy files, to the temporary storage device. In an embodiment, the contents are copied using a raw copy, for example as copying an image of the NVRAM, to the temporary storage device. In an embodiment, a computer operator or administrative user initiates the copy function as a step during programming a wagering game machine. For example, the computer operator or administrative user can use a device to initiate and control the copying or alternatively, the operator or user can initiate the copying with a process or program. In some embodiments, the temporary storage device is a compact flash card containing instructions that initiate and control the copying of the contents of the NVRAM to a destination storage device. In other embodiments, a process, such as a stored program existing in the wagering game machine's main memory or in a specialized program module (e.g., a read-only memory module or a firmware module) is used to control the copying. The operator or user may initiate such a stored program using an on-screen display (e.g., an administrative menu), a specialized wired or wireless device (e.g., an administrative key fob or controller unit), or by manipulating hardware, which may reside inside a wagering game machine's cabinet (e.g., a reset button). In some embodiments, the operation that initiates the copying is sent from a server machine. The client (i.e., a wagering game machine) can receive the control signal and initiate the method 300. In certain embodiments, security features exist to ensure that such a control signal is authentic (e.g., a secured wired or wireless channel, use of certificates, encryption schemes, or private networks).

The temporary storage device can include in various embodiments, volatile or non-volatile memory, such as a hard disk, flash memory, or random access memory (RAM). In further embodiments, the temporary storage device is a removable media, such as a universal serial bus (USB) memory stick or a hot-swappable hard drive. In other embodiments, the temporary storage device includes one or more of an optical drive (e.g., CD-RW drive or DVD-RW drive) or a network storage device.

In an embodiment, some or all of the data copied from the NVRAM module to the temporary storage device is compressed. In an embodiment, the transferred data is encrypted or protected by other security measures, such as a password.

At 304, the NVRAM module 138 is cleared. In an embodiment, the clearing is performed by writing zeros to every address location in the NVRAM module 138. This may be preferred to ensure that subsequent games that access a previously used memory range are not able to intentionally or accidentally retrieve false, inconsistent, or inaccurate data related to the previous game files. In other embodiments, only enough of the NVRAM is cleared to destroy the file system. In an embodiment, clearing is performed by writing ones to certain addresses or ranges of addresses to destroy the data or file system. In an embodiment, the clearing is performed by calling another process or sending a control command to a device to clear the NVRAM. For example, the NVRAM management unit 136 can initialize and run executable code that exists in the wagering game machine's main memory 128. In an embodiment, step 304 is optional and may not be performed.

At 306, the NVRAM management unit 136 copies data into the NVRAM module 138. In an embodiment, the data can comprise some or all of the previous contents of the NVRAM, which are stored on the temporary storage device. In an embodiment, if a structured copy was used to copy files to the temporary storage device, then after a file system is created on the cleared NVRAM, files can be copied or moved back to the NVRAM. In contrast, in another embodiment, if a raw copy, such as an image, was used to transfer the contents of the NVRAM to the temporary storage device, then files can be read from the raw copy (e.g., image) on the temporary storage device and transferred to the NVRAM or alternatively, part or all of the raw data can be transferred to the NVRAM. In an embodiment, some or all of the data to be stored on the NVRAM module 138 is generated by a process. For example, after the NVRAM is cleared, an operator can install a new game program, where the initial steps of installation include clearing some or all of the NVRAM, formatting the NVRAM with a new file system, and then installing necessary default game files. In an embodiment, some or all of the data is copied from a source other than the temporary storage device. In an embodiment, some of all of the data copied to the NVRAM is from the temporary storage device and is either a subset or a superset of the data initially copied from the NVRAM to the temporary storage device.

In certain embodiments, the data is compressed or uncompressed files, encrypted data, or executable data. For example, in order to improve the capacity efficiency of the temporary storage device, the data can be compressed after being copied to the temporary storage device and then decompressed before being copied back to the NVRAM module 138. Alternatively, the data can be copied back to the NVRAM module 138 in a compressed state and then decompressed by a process or program that accesses the data. In some embodiments, an authentication, verification or confirmation step is inherent to the copying process. For example, after a file is copied for a storage device to the NVRAM module 138, a process is used to calculate a checksum and compare it to a known value to verify an accurate copy.

Example Wagering Game Machine

Figure 4:
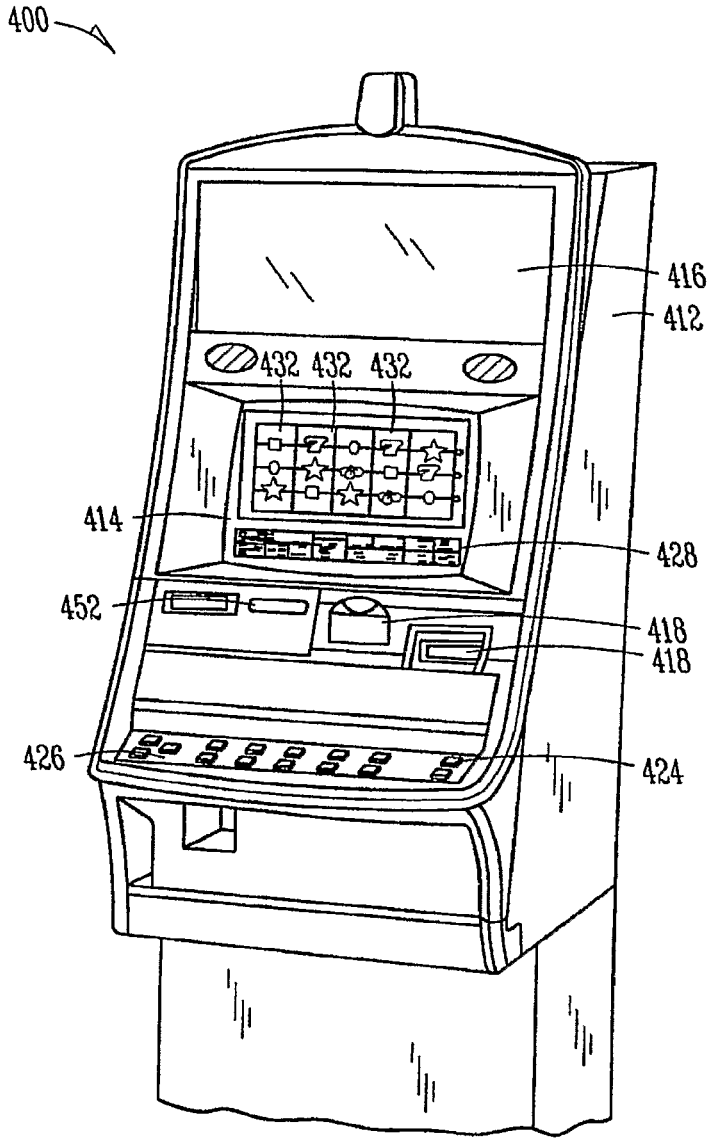
FIG. 4 is a perspective view of a wagering game machine, according to example embodiments of the invention.

FIG. 4 is a perspective view of a wagering game machine, according to example embodiments of the invention. Referring to FIG. 4, a wagering game machine 400 is used in gaming establishments, such as casinos. According to embodiments, the wagering game machine 400 can be any type of wagering game machine and can have varying structures and methods of operation. For example, the wagering game machine 400 can be an electromechanical wagering game machine configured to play mechanical slots, or it can be an electronic wagering game machine configured to play video casino games, such as blackjack, slots, keno, poker, blackjack, roulette, etc.

The wagering game machine 400 comprises a housing 412 and includes input devices, including value input devices 418 and a player input device 424. For output, the wagering game machine 400 includes a primary display 414 for displaying information about a basic wagering game. The primary display 414 can also display information about a bonus wagering game and a progressive wagering game. The wagering game machine 400 also includes a secondary display 416 for displaying wagering game events, wagering game outcomes, and/or signage information. While some components of the wagering game machine 400 are described herein, numerous other elements can exist and can be used in any number or combination to create varying forms of the wagering game machine 400.

The value input devices 418 can take any suitable form and can be located on the front of the housing 412. The value input devices 418 can receive currency and/or credits inserted by a player. The value input devices 418 can include coin acceptors for receiving coin currency and bill acceptors for receiving paper currency. Furthermore, the value input devices 418 can include ticket readers or barcode scanners for reading information stored on vouchers, cards, or other tangible portable storage devices. The vouchers or cards can authorize access to central accounts, which can transfer money to the wagering game machine 400.

The player input device 424 comprises a plurality of push buttons on a button panel 426 for operating the wagering game machine 400. In addition, or alternatively, the player input device 424 can comprise a touch screen 428 mounted over the primary display 414 and/or secondary display 416.

The various components of the wagering game machine 400 can be connected directly to, or contained within, the housing 412. Alternatively, some of the wagering game machine's components can be located outside of the housing 412, while being communicatively coupled with the wagering game machine 400 using any suitable wired or wireless communication technology.

The operation of the basic wagering game can be displayed to the player on the primary display 414. The primary display 414 can also display a bonus game associated with the basic wagering game. The primary display 414 can include a cathode ray tube (CRT), a high resolution liquid crystal display (LCD), a plasma display, light emitting diodes (LEDs), or any other type of display suitable for use in the wagering game machine 400. Alternatively, the primary display 414 can include a number of mechanical reels to display the outcome. In FIG. 4, the wagering game machine 400 is an "upright" version in which the primary display 414 is oriented vertically relative to the player. Alternatively, the wagering game machine can be a "slant-top" version in which the primary display 414 is slanted at about a thirty-degree angle toward the player of the wagering game machine 400. In yet another embodiment, the wagering game machine 400 can be a bartop model, a mobile handheld model, or a workstation console model.

A player begins playing a basic wagering game by making a wager via the value input device 418. The player can initiate play by using the player input device's buttons or touch screen 428. The basic game can include arranging a plurality of symbols along a payline 432, which indicates one or more outcomes of the basic game. Such outcomes can be randomly selected in response to player input. At least one of the outcomes, which can include any variation or combination of symbols, can trigger a bonus game.

In some embodiments, the wagering game machine 400 can also include an information reader 452, which can include a card reader, ticket reader, bar code scanner, RFID transceiver, or computer readable storage medium interface. In some embodiments, the information reader 452 can be used to award complimentary services, restore game assets, track player habits, etc.

In some embodiments, the wagering game machine 400 can also include an information reader, which can include a card reader, ticket reader, bar code scanner, RFID transceiver, or computer readable storage medium interface. In some embodiments, the information reader can be used to award complimentary services, restore game assets, track player habits, etc.

In some embodiments, the wagering machine is a stand alone gaming device, a mobile gaming device, or a gaming device in a server-based gaming system.

General Comments

In the above detailed description, reference is made to specific examples by way of drawings and illustrations. These embodiments, which are also referred to herein as "examples," are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The above detailed description does not, therefore, limit embodiments of the invention, which are defined only by the appended claims.

Each of the embodiments described herein are contemplated as falling within the inventive subject matter, which is set forth in the following claims.

What is claimed is:

1. A computer-implemented method of operating a gaming system that conducts a casino wagering game, the gaming system including a gaming housing, a random element generator, one or more processing units, an electronic display device, a non-volatile random access memory (NVRAM) module, a non-volatile storage device, and an electronic input device, the electronic display device and the electronic input device being disposed on the gaming housing, the method comprising:

generating one or more random elements with the random element generator;

receiving, responsive to a physical input to the electronic input device, a wager input to initiate the casino wagering game;

determining, by the one or more processing units, an outcome of the casino wagering game based, at least in part, on the one or more random elements;

displaying the outcome on the electronic display device;

awarding, by the one or more processing units, a tangible award in response to the outcome meeting a predetermined award criterion;

storing, in the NVRAM module, first critical data produced by conducting the casino wagering game;

copying the first critical data to the non-volatile storage device;

clearing the first data from the NVRAM module before copying second critical data to the NVRAM module; and copying the second critical data from the non-volatile storage device to the cleared NVRAM module, wherein the critical data comprises a portion of the first critical data.

2. The method of claim 1, wherein copying the first critical data comprises using a structured copy technique.

3. The method of claim 1, wherein copying the first critical data comprises using a raw copy technique.

4. The method of claim 1, wherein copying the second critical data comprises using a structured copy technique.

5. The method of claim 1, wherein the first critical data includes one or more of: a game outcome, credit balance, reel position, game history, random number generator seed, game configuration, machine configuration, player information, or wagering game machine state information.

6. The method of claim 1, further comprising formatting the NVRAM module before copying the second critical data, wherein the formatting includes creating a file system.

7. The method of claim 1, further comprising formatting the NVRAM module before copying the second critical data, wherein the NVRAM module is formatted using fixed partitions.

8. The method of claim 1, wherein the non-volatile storage device comprises one or more of:

a hard drive, flash memory, random access memory, a removable hard drive, a USB memory stick, an optical drive, or a network storage device.

9. The method of claim 1, further comprising compressing the first critical data on the non-volatile storage device.

10. The method of claim 1, further comprising verifying at least one of:

an accuracy, an origin, an authenticity, or an integrity of the second critical data.

11. The method of claim 1, wherein clearing the NVRAM module comprises writing a pattern of zeros to address locations in the NVRAM module.

12. The method of claim 1, wherein clearing the NVRAM module comprises writing zeros to every address location in the NVRAM module.

13. The method of claim 1, wherein clearing the NVRAM module comprises destroying a file system in the NVRAM module by writing ones to certain addresses in the NVRAM module.

14. A non-transitory machine-readable medium including instructions that, when performed by a gaming system, cause the gaming system to:

generate one or more random elements with a random element generator;

receive, responsive to a physical input to an electronic input device, a wager input to initiate a casino wagering game;

determine, by one or more processing units, an outcome of the casino wagering game based, at least in part, on the one or more random elements;

display the outcome on an electronic display device;

award, by the one or more processing units, a tangible award in response to the outcome meeting a predetermined award criterion;

store, in a NVRAM module, first critical data produced by conducting the casino wagering game;

copy the first critical data to a non-volatile storage device;

clear the first critical data from the NVRAM module before copying second critical data to the NVRAM module; and copy the second critical data from the non-volatile storage device to the cleared NVRAM module, wherein the second critical data comprises a portion of the first critical data.

15. The machine-readable medium of claim 14, further comprising instructions to format the NVRAM module before copying the second critical data, wherein the formatting includes creating a file system.

16. The machine-readable medium of claim 14, further comprising instructions to verify at least one of:

an accuracy, an origin, an authenticity, or an integrity of the second critical data.

17. The machine-readable medium of claim 14, wherein the instructions to clear the NVRAM module comprise instructions to write a pattern of zeros to address locations in the NVRAM module.

18. The machine-readable medium of claim 14, wherein the instructions to clear the NVRAM module comprise instructions to write zeros to every address location in the NVRAM module.

19. The machine-readable medium of claim 14, wherein the instructions to clear the NVRAM module comprise instructions to write ones to certain addresses in the NVRAM module in order to destroy a file system.

20. A gaming machine for conducting a casino wagering game, the gaming machine comprising:

a gaming housing;

an electronic display device disposed on the gaming housing;

an electronic input device disposed on the gaming housing, the electronic input device configured to receive physical input from a player to initiate the casino wagering game and transform the input into an electronic data signal;

a random element generator;

an NVRAM module; and one or more processing units configured to:

initiate the casino wagering game in response to the electronic data signal from the electronic input device;

determine an outcome of the casino wagering game based, at least in part, on the one or more random elements;

direct the electronic display device to display the outcome;

award, by the one or more processing units, a tangible award in response to the outcome meeting a predetermined award criterion;

store, in the NVRAM module, first critical data produced by conducting the wagering game;

copy the first critical data to a non-volatile storage device;

clear the first critical data from the NVRAM module before copying second critical data to the NVRAM module; and copy the second critical data from the storage device to the cleared NVRAM module, wherein the second critical data comprises a portion of the first critical data.

21. The gaming machine of claim 20, wherein the one or more processors are further operable to verify at least one of an accuracy, an origin, an authenticity, or an integrity of the second data.

22. The gaming machine of claim 20, wherein the non-volatile temporary storage device includes removable media.

23. The gaming machine of claim 20, wherein the non-volatile temporary storage device is accessed using a network.

24. The gaming machine of claim 20, wherein the NVRAM module is cleared by writing a pattern of zeros to address locations in the NVRAM module.

25. The gaming machine of claim 20, wherein the NVRAM module is cleared by writing zeros to every address location in the NVRAM module.

26. The gaming machine of claim 20, wherein the NVRAM module is cleared by writing ones to certain addresses in the NVRAM module in order to destroy a file system.

27. A gaming system for conducting a casino wagering game, the gaming system comprising:

a gaming housing for housing components associated with the casino wagering game;

an electronic display device disposed on the gaming housing;

an electronic input device disposed on the gaming housing, the electronic input device configured to receive a physical input from a player to initiate the casino wagering game and transform the input into an electronic data symbol;

a random element generator configured to generate one or more random elements;

an NVRAM module;

a non-volatile storage device; and one or more processing units configured to:

initiate the casino wagering game in response to the electronic data signal from the electronic input device;

determine an outcome of the casino wagering game based, at least in part, on the one or more random elements;

award a tangible award in response to the outcome meeting a predetermined award criterion;

store, in the NVRAM, first critical data produced by conducting the casino wagering game;

copy the first critical data to the non-volatile temporary storage device;

clear the first critical data from the NVRAM module before copying second critical data to the NVRAM module; and copy the second critical data from the non-volatile temporary storage device to the cleared NVRAM module, wherein the second critical data comprises a portion of the first critical data.

28. The system of claim 27, wherein the non-volatile temporary storage device includes a removable media.

29. The system of claim 27, wherein the one or more processing units are further operable to:

analyze the second critical data to obtain a checksum value; and compare the checksum value to a known value to verify that the second critical data is an accurate copy.

30. The system of claim 27, wherein the one or more processing units clear the NVRAM module by writing a pattern of zeros to address locations in the NVRAM module.

31. The system of claim 27, wherein the second critical data includes an image file.

32. The system of claim 27, wherein the one or more processing units clear the NVRAM module by writing ones to certain addresses in the NVRAM module in order to destroy a file system.

* * * * *